US006628076B2

(12) United States Patent
Amatsuchi

(10) Patent No.: US 6,628,076 B2
(45) Date of Patent: Sep. 30, 2003

(54) PLASMA DISPLAY PANEL

(75) Inventor: Mario Amatsuchi, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 190 days.

(21) Appl. No.: 09/939,753

(22) Filed: Aug. 28, 2001

(65) Prior Publication Data

US 2002/0024304 A1 Feb. 28, 2002

(30) Foreign Application Priority Data

Aug. 28, 2000 (JP) ..... 2000-257442

(51) Int. Cl.[7] ..... H01J 11/00

(52) U.S. Cl. ..... 313/586; 313/587; 313/495; 313/484

(58) Field of Search ..... 313/518, 586, 313/587, 489, 491, 494, 582, 583, 495, 496, 484; 345/60; 445/24, 25

(56) References Cited

U.S. PATENT DOCUMENTS 4,100,447 A * 7/1978 Tsui et al. ..... 313/582
5,962,974 A * 10/1999 Komaki et al. ..... 313/582

* cited by examiner

*Primary Examiner*—Nimeshkumar D. Patel
*Assistant Examiner*—Sharlene Leurig
(74) *Attorney, Agent, or Firm*—Arent Fox Kintner Plotkin & Kahn

(57) ABSTRACT

A plasma display panel (10) includes a front glass substrate (11) having the inner face on which row electrode pairs (X, Y) each opposing each other through a discharge gap (g) and a dielectric layer (13) overlaying the row electrode pairs (X, Y) relative to a discharge space (S). In such plasma display panel (10), a low dielectric constant layer (12) having a relative dielectric constant lower than that of the front glass substrate (11) is provided between the front glass substrate (11) and the row electrode pair (X, Y).

9 Claims, 12 Drawing Sheets

V 2 − V 2

V 1 − V 1

V 2 − V 2

W1 — W1

W2 — W2

V 3 – V 3

PLASMA DISPLAY PANEL

BACKGROUND OF THE INVENTION

1. Field of the Invention

This invention relates to a structure of a plasma display panel in which a display image is generated by means of producing a discharge between a pair of electrodes on which a dielectric layer overlays.

The present application claims priority from Japanese Application No. 2000-257442, the disclosure of which is incorporated herein by reference for all purposes.

2. Description of the Related Art

A plasma display panel (hereinafter referred to as "PDP") serving as an oversize and slim image display panel is used in a public display unit such as in a television receiver, an information board or a display board. A surface discharge scheme AC type of PDP is commercially manufactured.

The surface discharge scheme AC type PDP includes, as illustrated in FIG. 17, a front glass substrate 1 and a back glass substrate 4 which is placed opposite to the front glass substrate 1 with a discharge space in between. The front glass substrate 1 has the inner face on which row electrode pairs (X', Y'), a dielectric layer 2 overlaying the row electrode pairs (X', Y'), and a protective layer 3 for protecting the dielectric layer 2 are provided, while the back glass substrate 4 has the interior surface on which column electrodes D', phosphor layers 6R, 6G, 6B individually overlaying the column electrodes D', and partition walls 5 partitioning a discharge space are provided, in which discharge cells are formed at particular intersecting areas of the row electrode pairs (X', Y') and the column electrodes D'.

With the above PDP, a discharge (opposite discharge) is caused selectively between one of the row electrode pair (X', Y') and the column electrode D' in each discharge cell, to scatter lighted cells (the discharge cell in which wall charge is formed on the dielectric layer 2) and nonlighted cells (the discharge cell in which wall charge is not formed on the dielectric layer 2) over the panel surface. After that, in all the display lines L, discharge sustaining pulses are applied to the row electrodes X', Y' in unison, to produce a sustain discharge (surface discharge) in the lighted cells.

Hence, the discharge gas filled in the discharge space generates ultraviolet radiation. The ultraviolet radiation causes the red phosphor layer 6R and/or the green phosphor layer 6G and/or the blue phosphor layer 6B, colors of which serves as the primary colors and which are formed in the corresponding discharge cells, to emit light to form an image on the panel.

In the PDP, interelectrode capacitance in each discharge cell is formed by the row electrode pair (X', Y') and dielectric layer 2, and by the row electrode pair (X', Y') and front glass substrate 1.

In the conventional PDP, a relative dielectric constant of the front glass substrate 1 is the order of eight, which is set at a relatively high value.

This produces a problem in which when the discharge sustaining pulses are applied alternately between a pair of the row electrodes X' and Y' to produce the sustain discharge (surface discharge), a larger interelectrode capacitance formed by the row electrode pair (X', Y') and the front glass substrate 1 results in an increase of reactive power (electric power which does not work on light emission).

The conventional PDP has a problem in which the reactive power further increases when a higher voltage of the discharge sustaining pulse is supplied for high-voltage driving in order to increase the efficiency of light emission.

SUMMARY OF THE INVENTION

The present invention has been made to solve the problems associated with the surface discharge scheme alternating current type plasma display panel as described above.

It is therefore an object of the present invention to provide a plasma display panel which allows reduction in reactive power when a sustain discharge is produced, while allowing high-voltage driving.

To attain the above object, a plasma display panel according to a first aspect of the present invention includes a pair of substrates which face each other with a discharge space in between and one of which has an inner face on which row electrode pairs each opposing each other with a discharge gap in between, and a dielectric layer overlaying the row electrode pairs relative to the discharge space are provided. Such plasma display panel features in that a low dielectric constant layer having a relative dielectric constant lower than that of the above-described one substrate is provided between the above-described one substrate and the row electrode pair.

In the plasma display panel according to the first aspect, interelectrode capacitance in each of unit light emitting areas is formed by the row electrode pair and dielectric layer and the row electrode pair and above-described one substrate, and additionally, by the low dielectric constant layer which is provided between the above-described one substrate and the row electrode pair.

With the plasma display panel, addressing operation is performed in order to scatter the lighted unit light emitting areas (the unit light emitting area in which wall charge is formed on the dielectric layer) and the nonlighted unit light emitting areas (the unit light emitting area in which wall charge is not formed on the dielectric layer) over the panel surface in accordance with an image to be displayed.

Then, discharge sustaining pulses are applied to the row electrode pairs to cause a sustain discharge (surface discharge) in each lighted unit light emitting area.

At this time, reactive power (electric power does not work on light emission) occurs due to the interelectrode capacitance formed by the row electrode pair and above-described one substrate.

However, by providing the low dielectric constant layer between the row electrode pair and the above-described one substrate, it is possible to decrease in thickness of portion of the above-described one substrate which faces the row electrode pair as compared with that of a conventional substrate. Further, since the low dielectric constant layer has a relative dielectric constant lower than that of the above-described one substrate, it is possible to reduce the interelectrode capacitance inducing the reactive power.

In consequence, according to the first aspect, the amount of reactive power occurring when the sustain discharge is produced for generating an image can be reduced as compared with the conventional plasma display panel. Further, the reactive power can be reduced even when a higher voltage of the discharge sustaining pulse is supplied for high-voltage driving in order to increase the efficiency of light emission.

To attain the aforementioned object, the plasma display panel according to a second aspect features, in addition to the configuration of the first aspect, in that the relative dielectric constant of the low dielectric constant layer is six or less.

With this configuration, the relative dielectric constant of the low dielectric constant layer is set at a value lower than a value of a relative dielectric constant of the substrate which is typically the order of eight.

This allows reduction in reactive power occurring when the sustain discharge is produced for forming the image as compared with the conventional plasma display panel. Additionally, even when a higher voltage of the discharge sustaining pulse is supplied for high-voltage driving in order to increase in the efficiency of light emission, the reactive power can be reduced.

To attain the aforementioned object, the plasma display panel according to a third aspect features, in addition to the configuration of the first aspect, in that the low dielectric constant layer includes $SiO_2$. With the configuration, the relative dielectric constant of the low dielectric constant layer can be set at a value lower than that of the relative dielectric constant of the substrate.

To attain the aforementioned object, the plasma display panel according to a fourth aspect features, in addition to the configuration of the first aspect, in that the above-described one substrate is a front substrate placed on the display surface side of the panel and in that the low dielectric constant layer is formed of light-transmittable materials.

According to the plasma display panel of the fourth aspect, the interelectrode capacitance formed by the front substrate and the row electrode pair is decreased due to the low dielectric constant layer provided between the front substrate and the row electrode pair. Additionally, since the low dielectric constant layer is formed of the light-transmittable materials, the provision of the low dielectric constant layer may not inhibit the generation of images.

To attain the aforementioned object, the plasma display panel according to a fifth aspect features, in addition to the configuration of the first aspect, in that the low dielectric constant layer is provided over almost the entire inner face of the one substrate. With the configuration, the interelectrode capacitance formed by the row electrode pairs and the one substrate can be sufficiently reduced.

To attain the aforementioned object, the plasma display panel according to a sixth aspect features, in addition to the configuration of the fifth aspect, in that the low dielectric constant layer is provided on the inner face of the aforementioned one substrate except on at least a portion opposite to a discharge gap between each of the row electrode pairs.

According to the plasma display panel of the sixth aspect, when the sustain discharge is produced for generating the image, as the interelectrode capacitance formed by the row electrode pair and the one substrate is reduced due to the provision of the low dielectric constant layer, the reactive power reduces.

In this point, since the low dielectric constant layer is provided on portions except the portion opposite to the discharge gap between the row electrode pair, and a pair of the row electrodes oppose each other through the dielectric layer having a large relative dielectric constant, a distance for producing a discharge is shorter, resulting in decreasing a voltage for starting the discharge.

To attain the aforementioned object, the plasma display panel according to a seventh aspect features, in addition to the configuration of the first aspect, in that the low dielectric constant layer is provided only on a portion, opposite to each of the row electrode pairs, of portions of the inner face of the aforementioned one substrate which is opposite the discharge space.

With the configuration, since a pair of the row electrodes oppose each other through the dielectric layer having a large relative dielectric constant, a distance for producing the discharge is shorter, resulting in decreasing a voltage for starting the discharge. Additionally, since the low dielectric constant layer is divided to decrease the area of the continuous portion, the low dielectric constant layer is protected from cracking.

To attain the aforementioned object, the plasma display panel according to an eighth aspect features, in addition to the configuration of the first aspect, in that the low dielectric constant layer is formed in an island shape in each row electrode pair so as to separate it from other low dielectric constant layer.

With this configuration, the low dielectric constant layer is divided to decrease the area of the continuous portion. Hence, the low dielectric constant layer is protected from cracking.

To attain the aforementioned object, the plasma display panel according to a ninth aspect features, in addition to the configuration of the first aspect, in that the low dielectric layer is provided on portions of the inner face of the aforementioned one substrate except on a portion facing a portion between adjacent row electrode pairs, and in that a light absorption layer is provided on the portion, facing the portion between the adjacent row electrode pairs, of the inner face of the one substrate.

With this configuration, the reflection of ambient light incident upon the non-light emitting area on the panel surface is prevented, resulting in the prevention of inferior contrast on the screen.

DETAILED DESCRIPTION OF THE PREFERRED EMBODIMENT

Most preferred embodiment according to the present invention will be described hereinafter in detail with reference to the accompanying drawings.

Figure 1:
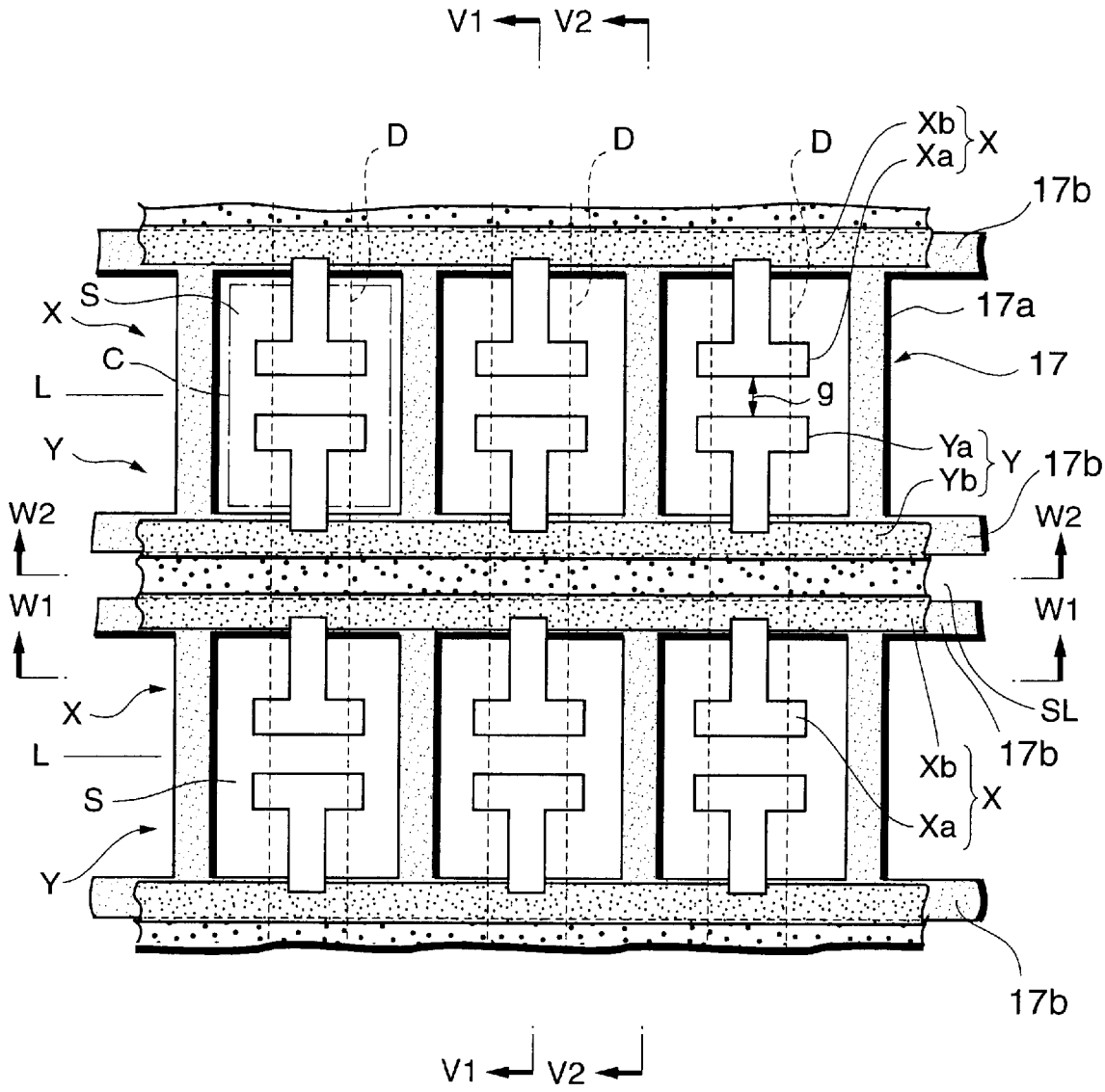
FIG. 1 is a front view schematically illustrating a first example according to the present invention.
Figure 2:
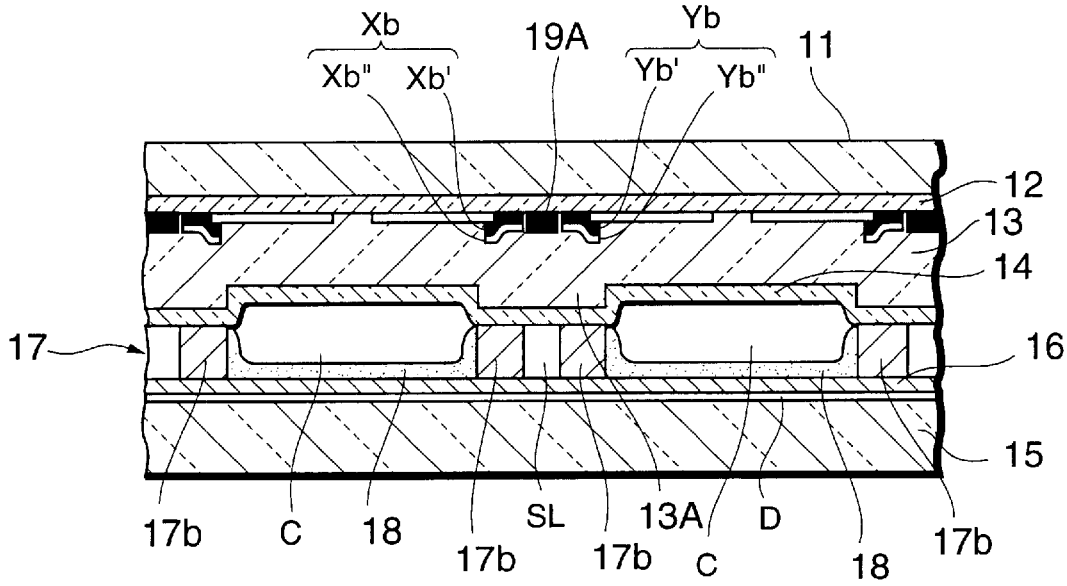
FIG. 2 is a sectional view taken along the V1—V1 line of FIG. 1.
Figure 3:
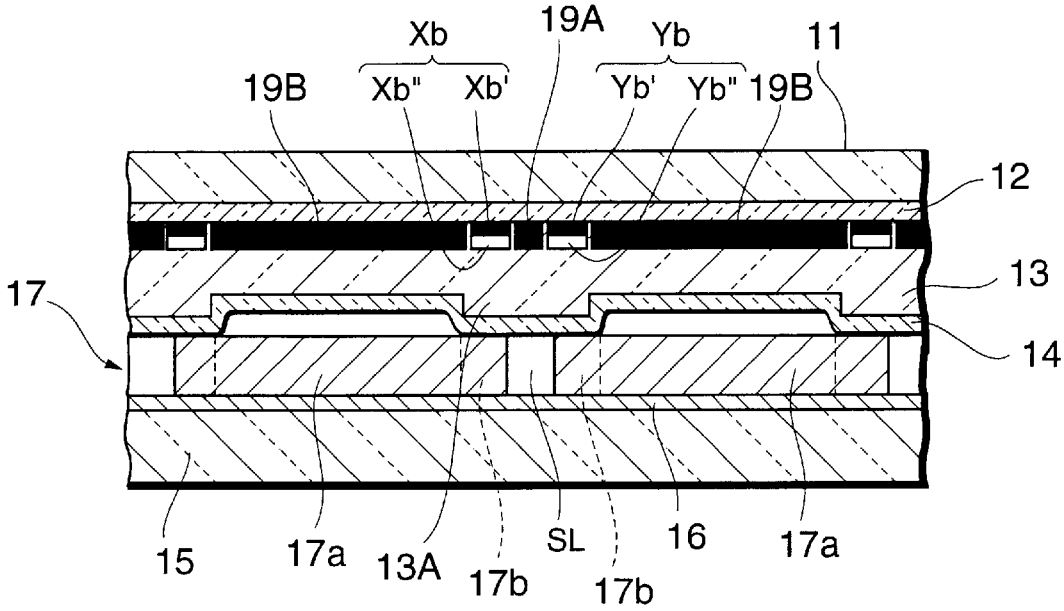
FIG. 3 is a sectional view taken along the V2—V2 line of FIG.
Figure 4:
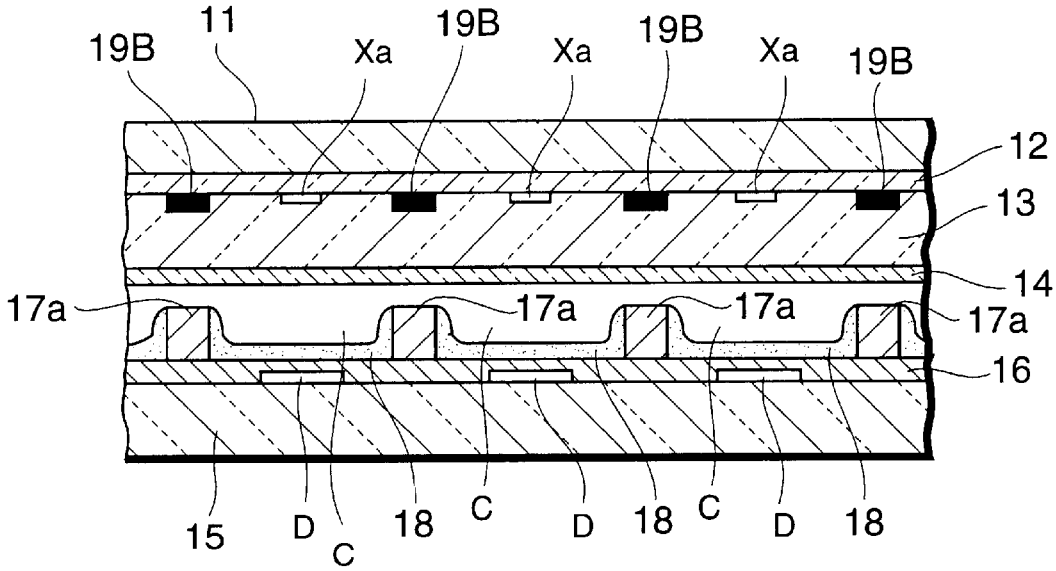
FIG. 4 is a sectional view taken along the W1—W1 line of FIG.
Figure 5:
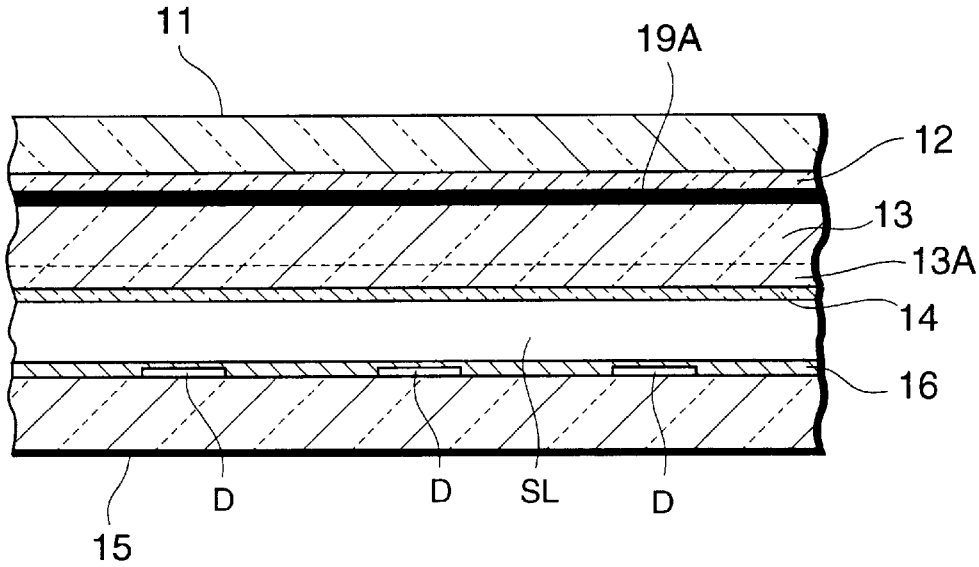
FIG. 5 is a sectional view taken along the W2—W2 line of FIG.

FIGS. 1 to 5 illustrate a first example of an embodiment of a plasma display panel according to the present invention: FIG. 1 is a front view; FIG. 2 is a sectional view taken along the V1—V1 line of FIG. 1; FIG. 3 is a sectional view taken along the V2—V2 line of FIG. 1; FIG. 4 is a sectional view taken along the W1—W1 line of FIG. 1; and FIG. 5 is a sectional view taken along the W2—W2 line of FIG. 1.

In the plasma display panel (hereinafter referred to as "PDP") 10 illustrated in FIG. 1 to FIG. 5, a low dielectric constant layer 12 is provided over a back surface of a front glass substrate 11 serving as a display surface.

The low dielectric constant layer 12 is formed of dielectric materials having a relative dielectric constant smaller than or equal to 6 which is a smaller value than that of the front glass substrate 11 (a relative dielectric constant: 8), e.g. a 96% pure silica glass ($SiO_2$), by means of a thin film forming technique such as evaporation or sputtering.

The low dielectric constant layer 12 is possibly set to have a film thickness between 20 $\mu$m and 80 $\mu$m. The front glass substrate 11 is decreased in thickness by that of the low dielectric constant layer 12, and the PDP 10 has substantially the same entire thickness as that of conventional PDPs.

On the back face of the low dielectric constant layer 12, a plurality of row electrode pairs (X, Y) are arranged in parallel so as to extend in the row direction (the traverse direction in FIG. 1) of the front glass substrate 11.

The row electrode X is composed of transparent electrodes Xa formed in a T-like shape of a transparent conductive film made of ITO (Indium Tin Oxide) or the like, and a bus electrode Xb which is formed of a metal film extending in the row direction of the front glass substrate 11 and connects to narrowed proximal ends of the respective transparent electrodes Xa.

Likewise, the row electrode Y is composed of transparent electrodes Ya which is formed in a T-like shape of a transparent conductive film made of ITO or the like, and a bus electrode Yb which is formed of a metal film extending in the row direction of the front glass substrate 11 to connect to narrowed proximal ends of the respective transparent electrodes Ya.

The row electrodes X and Y are alternated in the column direction (in the vertical direction in FIG. 1) of the front glass substrate 11. The transparent electrodes Xa and Ya arranged along the respective bus electrodes Xb and Yb, extend mutually toward the corresponding pair Xa or Ya such that the top sides (or the distal ends) of the widened portions of the transparent electrodes Xa and Ya face each other with a discharge gap g having a required width in between.

Each of the bus electrodes Xb and Yb is formed in a double-layer structure with a black conductive layer Xb', Yb' on the display surface side and a main conductive layer Xb", Yb" on the back surface side.

On the back face of the low dielectric constant layer 12, a dielectric layer 13 is further formed so as to overlay the row electrode pairs (X, Y). In turn, on the back face of the dielectric layer 13, an additional dielectric layer 13A is formed at each position opposing the adjacent bus electrodes Xb and Yb of the respective row electrode pairs (X, Y) adjacent to each other, and opposing each area between the adjacent bus electrodes Xb and Yb. The additional dielectric layer 13A is formed in such a manner as to protrude from the back face of the dielectric layer 13 and to extend in parallel to the bus electrodes Xb, Yb.

On the back faces of the dielectric layer 13 and the additional dielectric layers 13A, a protective layer 14 made of MgO is formed.

Further, a back glass substrate 15 is arranged in parallel to the front glass substrate 11. On the front face of the back glass substrate 15, column electrodes D are arranged in parallel at regularly established intervals from one another such that each column electrode D extends at positions opposing the transparent electrodes Xa and Ya of each row electrode pair (X, Y), in a direction orthogonal to the row electrode pair (X, Y) (the column direction).

A white dielectric layer 16 is further formed on the front face of the back glass substrate 15 and overlays the column electrodes D.

On the dielectric layer 16, a plurality of partition walls 17 are provided, each of which is formed in a ladder like pattern by vertical walls 17*a* each extending in the column direction between the adjacent column electrodes D arranged in parallel to each other, and transverse walls 17*b* each extending in the row direction in a position opposing each additional dielectric layer 13A.

The partition walls 17 are arranged in the column direction and spaced from each other at predetermined intervals by an interstice SL extending in the row direction. The ladder-like patterned partition walls 17 define the discharge space between the front glass substrate 11 and the back glass substrate 15 into areas each facing the paired transparent electrodes Xa and Ya in each row electrode pair (X, Y), thus forming quadrangular discharge cells C.

On the five faces of a surface of the dielectric layer 16 and the side faces of the vertical walls 17*a* and the transverse walls 17*b* of the partition wall 17 facing the discharge space in the discharge cell C, a phosphor layer 18 is formed so as to overlay all of them.

The phosphor layers 18 are set in order of red, green and blue of the prime colors for the sequence of discharge cells C in the row direction.

The inside of the discharge cell C is filled with a discharge gas.

Between the low dielectric constant layer 12 and the dielectric layer 13, a black light absorption layer 19A is provided between the back-to-back bus electrodes Xb and Yb of the respective row electrode pairs (X, Y) adjacent in the column direction so as to oppose the interstice SL provided between the partition walls 17 and to extend in the row direction along the bus electrodes Xb, Yb, and further a light absorption layer 19B is located at each position facing the vertical wall 17*a* of each partition wall 17.

For displaying images on the PDP, first, the addressing operation is performed in order that the discharge is caused selectively between the row electrode pair (X, Y) and the column electrode D in each discharge cell C, to scatter the lighted cells (the discharge cell in which the wall charge is formed on the dielectric layer 13) and the nonlighted cells (the discharge cell in which the wall charge is not formed on the dielectric layer 13) in all the display lines L over the panel in accordance with the image to be displayed.

After the addressing operation, in all the display lines L, the discharge sustaining pulse is applied alternately to the row electrode pairs (X, Y) in unison. In each lighted cell, the sustain discharge (surface discharge) is caused for every application of the sustaining discharge pulse.

In this manner, ultraviolet radiation is generated by the surface discharge in the lighted cells scattered over the panel surface in accordance with the image to be displayed. Thus, the red, green and blue phosphor layers 18 having the primary colors provided in the lighted cells are selectively excited to emit light, resulting in forming the image to be displayed.

With the above-described PDP 10, due to the provision of the low dielectric constant layer 12 between the front glass substrate 11 and the dielectric layer 13, interelectrode capacitance in each discharge cell is formed by the row electrode pair (X, Y) and low dielectric constant layer 12 as well as by the row electrode pair (X, Y) and dielectric layer 13 and the row electrode pair (X, Y) and front glass substrate 11.

The relative dielectric constant of the low dielectric constant layer 12 is smaller than that of the front glass substrate 11. For this reason, when the thickness of the PDP 10 is not changed, as the front glass substrate 11 is decreased in thickness by the thickness of the low dielectric constant layer 12, the interelectrode capacitance formed between the row electrode pair (X, Y) and the front glass substrate 11 is reduced.

Hence, when the sustain discharge (surface discharge) is produced for forming the image, as the interelectrode capacitance formed by the row electrode pair (X, Y) and the front glass substrate 11 is reduced due to the provision of the low dielectric constant layer 12, reactive power (electric power which does not work on light emission) decreases.

Further, even when a higher voltage of the discharge sustaining pulse is supplied for high-voltage driving in order to increase the efficiency of light emission, the reactive power also decreases.

Figure 6:
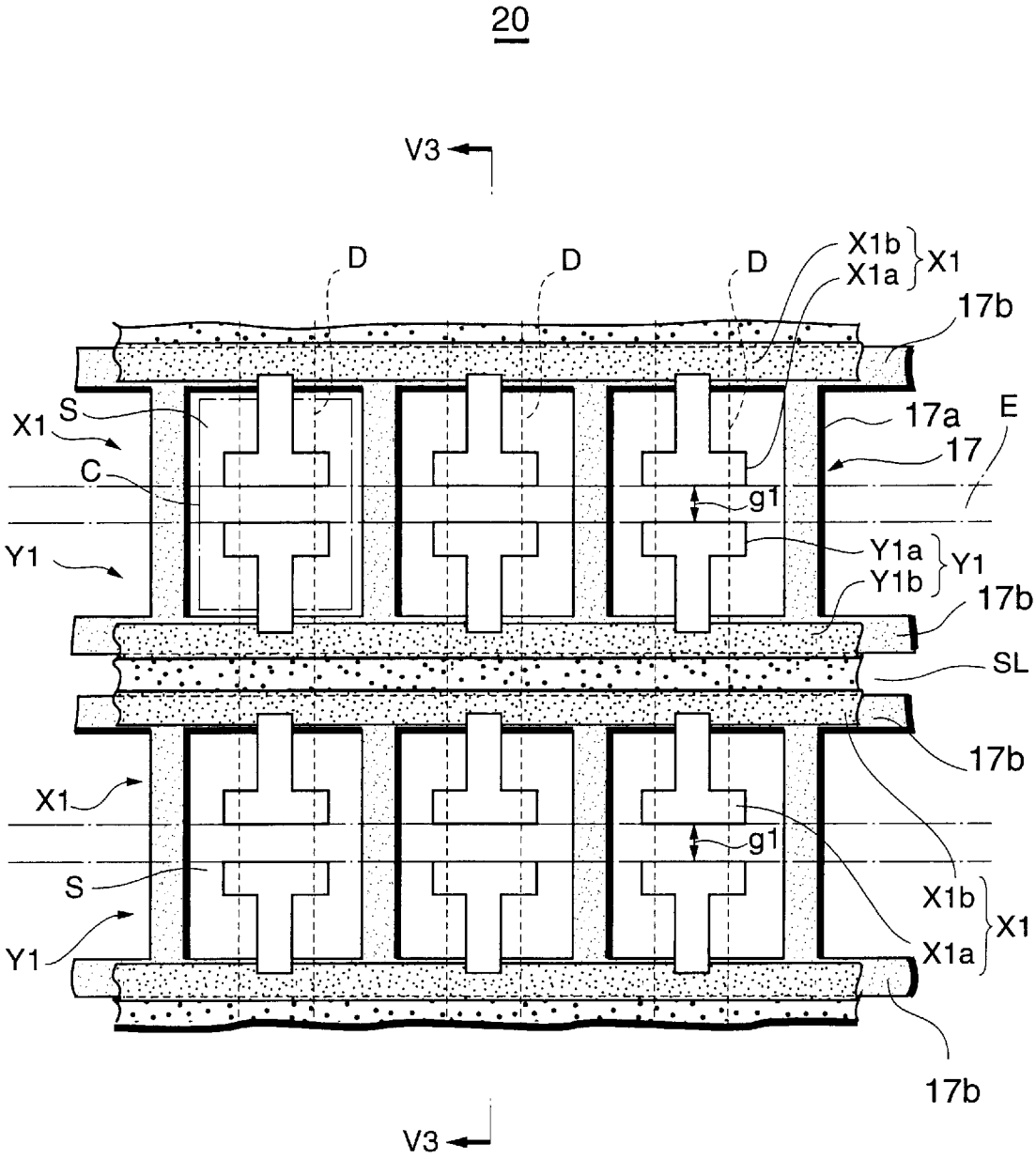
FIG. 6 is a front view schematically illustrating a second example according to the present invention.
Figure 7:
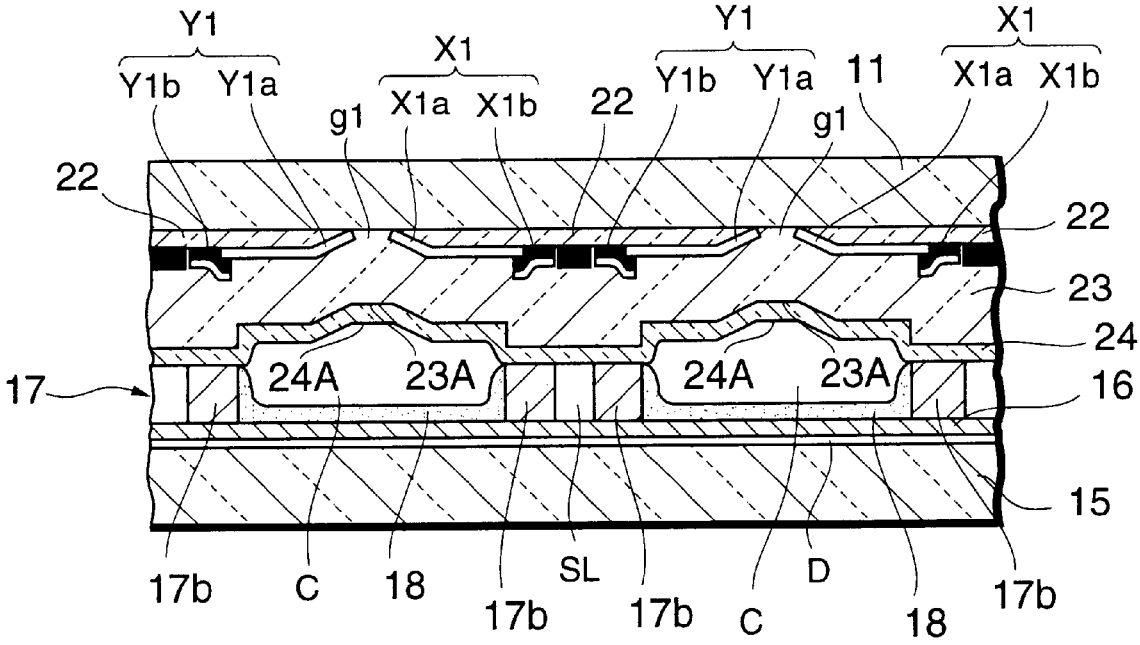
FIG. 7 is a sectional view taken along the V3—V3 line of FIG. 6.

Next, FIGS. 6 and 7 illustrate a second example of the embodiment of a plasma display panel according to the present invention: FIG. 6 is a front view, and FIG. 7 is a sectional view taken along the V3—V3 line of FIG. 6.

The PDP 20 in the second example has transparent electrodes X1*a*, Y1*a* of row electrodes X1, Y1 each of which is bent toward the front glass substrate 11 such that the leading end of the transparent electrode is situated at a position in almost contact with the back face of the front glass substrate 11.

A low dielectric constant layer 22 is formed in a band shape extending along the row direction in a range between the transparent electrodes X1*a* and Y1*a* of the respective row electrodes X1 and Y1 which are placed back to back.

Accordingly, any low dielectric constant layer is not provided in a band-shaped portion E extending in the row direction in the discharge gap g1 between each of the row electrode pairs (X1, Y1), which is represented with the one dotted chain line in FIG. 6.

At a portion of the back face of a dielectric layer 23, overlaying the row electrode pair (X1, Y1), which is opposite to each discharge gap g1 and at a portion of a protective layer 24 corresponding to the aforementioned portion, recesses 23A and 24A are respectively bent toward the front glass substrate 11 in order not to differ in thickness of the above portion of each dielectric layer 23 and protective layer 24 from that of other portions thereof.

The configuration of other components of the PDP 20 is the same as that of the aforementioned PDP 10 of the first example, which are represented with the same reference numerals.

As in the PDP 10 of the first example, in the PDP 20, when the sustain discharge (surface discharge) is produced, as interelectrode capacitance formed by the row electrode pair (X1, Y1) and the front glass substrate 11 is reduced due to the provision of the low dielectric constant layer 22, reactive power reduces.

With the PDP 20, the low dielectric constant layer 22 is provided only at the portion between the transparent electrodes X1*a* and Y1*a* of the back-to-back row electrodes X1, Y1. Further, the leading ends of the respective transparent electrodes X1*a* and Y1*a* of the row electrodes X1 and Y1 in each pair face each other through the dielectric layer 23 having a large relative dielectric constant. Thus, a distance for producing the discharge is shorter, resulting in decreasing a voltage for starting the discharge.

In the second example, even if the low dielectric constant layer is formed in a band-shaped portion (corresponding to the portion E in FIG. 6) facing the discharge gap g1 with a thickness smaller than that of other portions thereof and the leading ends of the respective transparent electrodes X1*a*, Y1*a* of the row electrodes X1, Y1 in each pair face each other through the dielectric layer 23, it is possible to provide the same effects.

Figure 8:
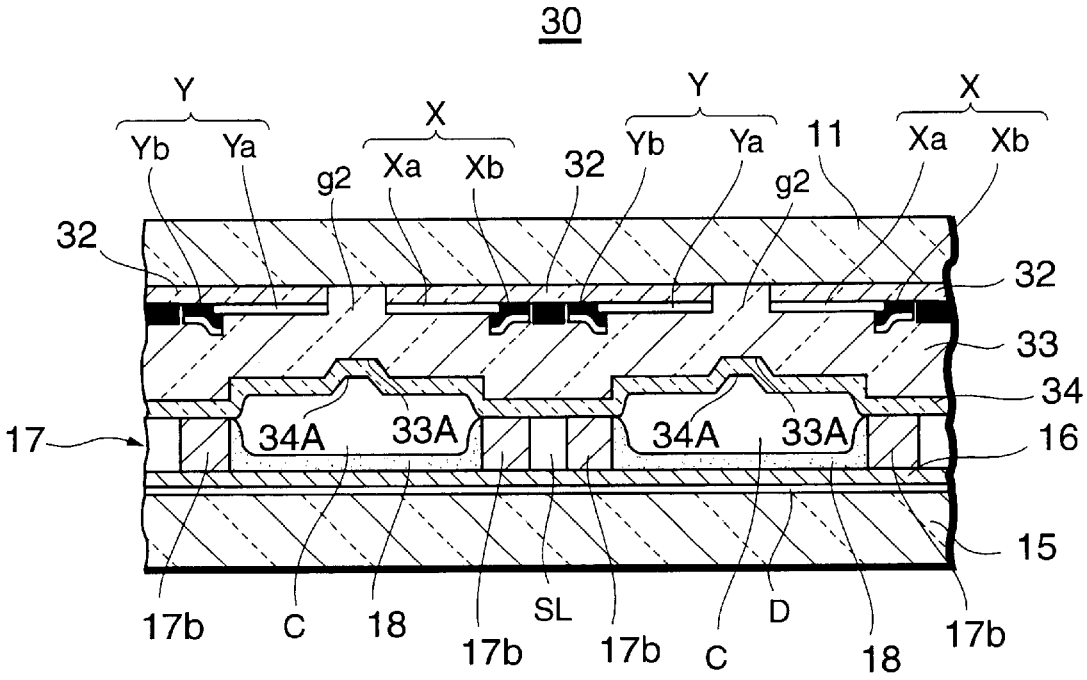
FIG. 8 is a side sectional view illustrating a third example according to the present invention.
Figure 9:
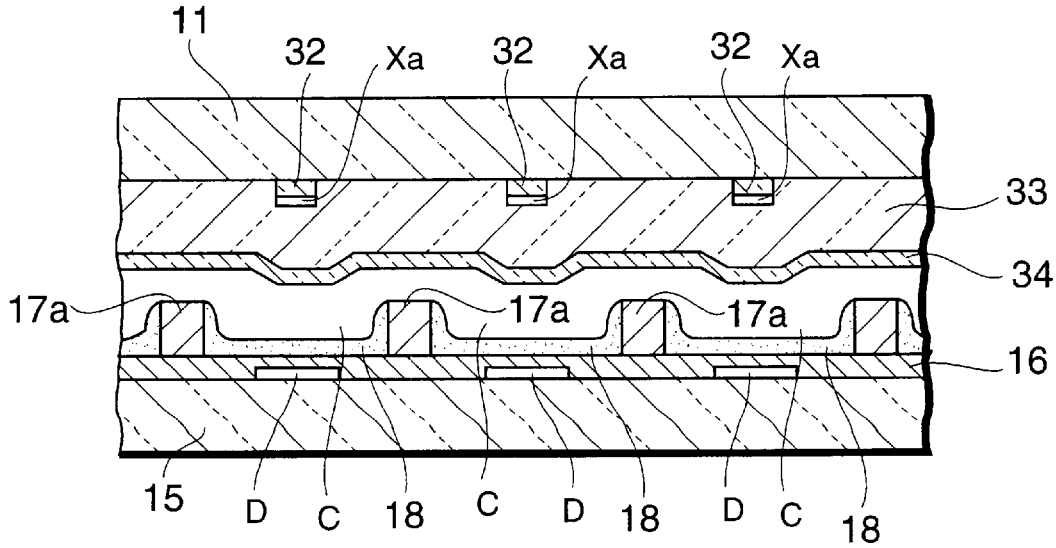
FIG. 9 is a transverse sectional view of the third example.
Figure 10:
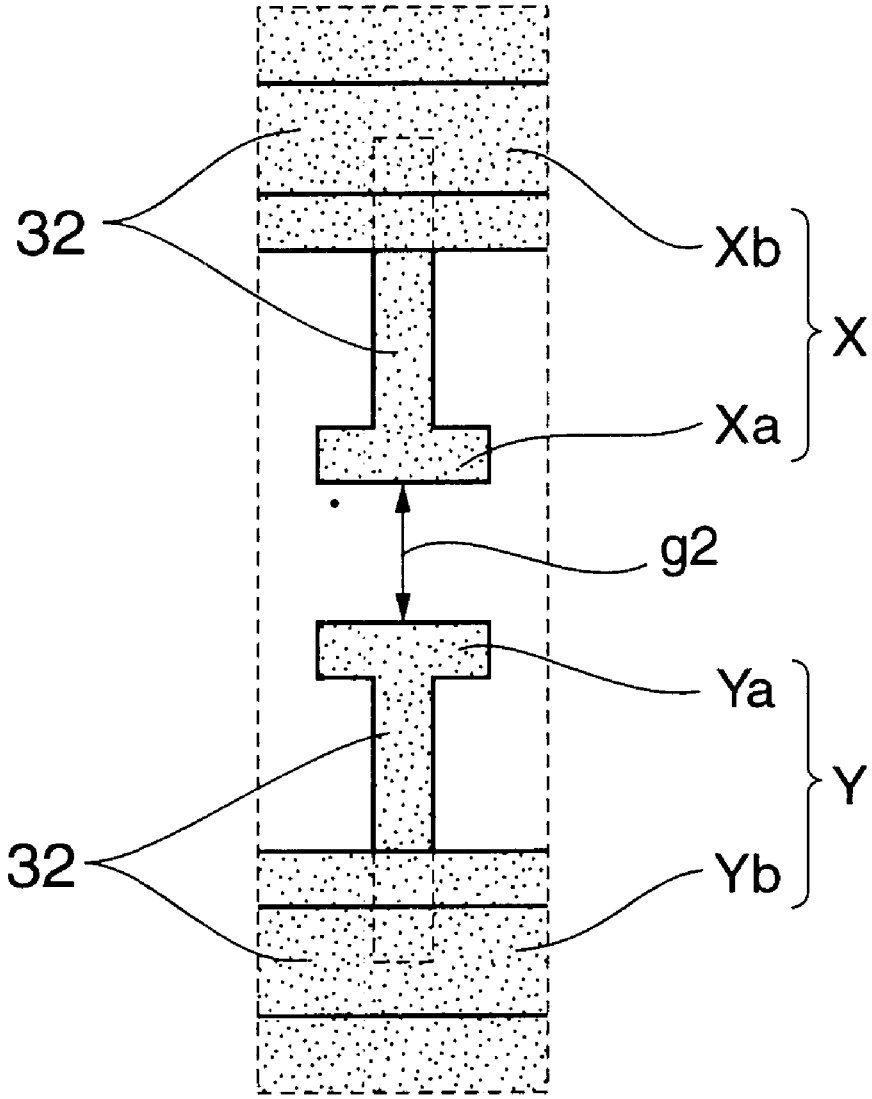
FIG. 10 is a schematic diagram showing a range in which a low dielectric constant layer is formed in a discharge cell in the third example.

FIGS. 8 to 10 illustrate a third example of the embodiment of the plasma display panel according to the present invention: FIG. 8 is a sectional view of the same position as that of FIG. 2 (the V1—V1 line) in the first example; FIG. 9 is a sectional view of the same position as that of FIG. 4 (the W1—W1 line); and FIG. 10 is a front view illustrating each of the discharge cells.

The PDP 30 in the third example has a low dielectric constant layer 32 between the front glass substrate 11 and a dielectric layer 33. The low dielectric constant layer 32 is only located at a position facing the transparent electrode Xa, Ya and the bus electrode Xb, Yb of each row electrode X, Y and also facing a portion between the back-to-back bus electrodes Xb and Yb of the adjacent row electrode pairs (X, Y). A low dielectric constant layer is not provided in a discharge gap g2 between each of the row electrode pairs (X, Y).

At a portion on the back of the dielectric layer 33, overlaying the row electrode pair (X, Y), which is opposite to each discharge gap g2 and at a portion of a protective layer 34 corresponding to the above portion, recesses 33A and 34A are respectively bent toward the front glass substrate 11 in order not to differ in thickness of the above portion of each dielectric layer 33 and protective layer 34 from that of other portions thereof.

The configuration of other components of the PDP 30 is the same as that of the aforementioned PDP 10 of the first example, which are represented with the same reference numerals.

As in the PDP 20 of the second example, in the PDP 30, when the sustain discharge (surface discharge) is produced, as interelectrode capacitance formed by the row electrode pair (X, Y) and the front glass substrate 11 is reduced due to the provision of the low dielectric constant layer 32, reactive power reduces. In addition, the leading ends of the respective transparent electrodes Xa and Ya of the row electrodes X, Y in each pair are opposite each other through the dielectric layer 33 having a large relative dielectric constant. Thus, a distance for producing the discharge is shorter, resulting in decreasing a voltage for starting the discharge.

Figure 11:
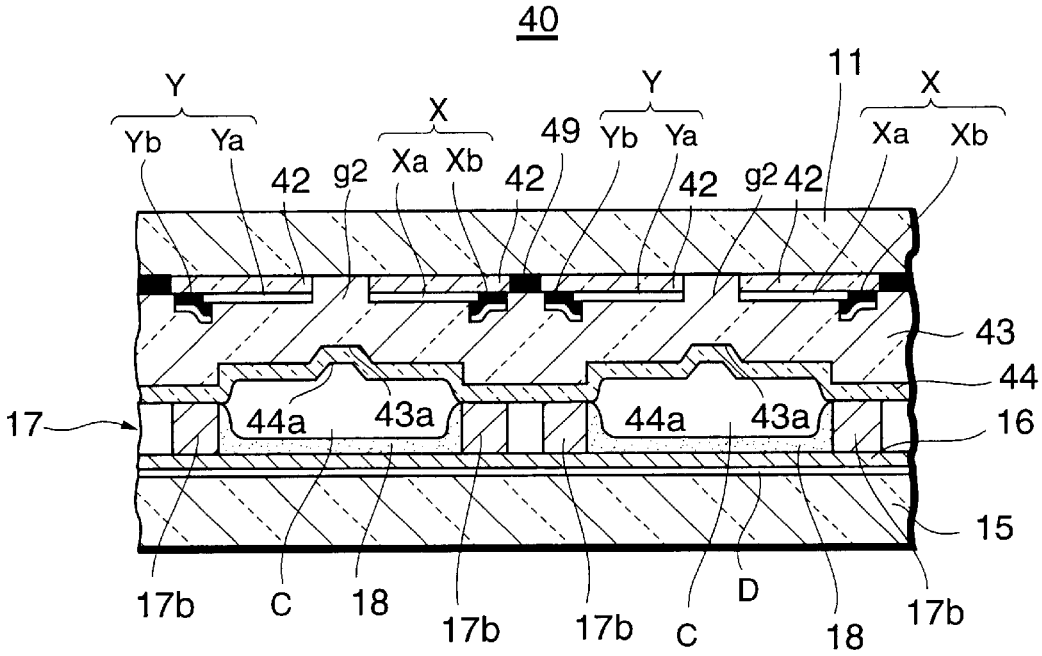
FIG. 11 is a side sectional view illustrating a fourth example according to the present invention.
Figure 12:
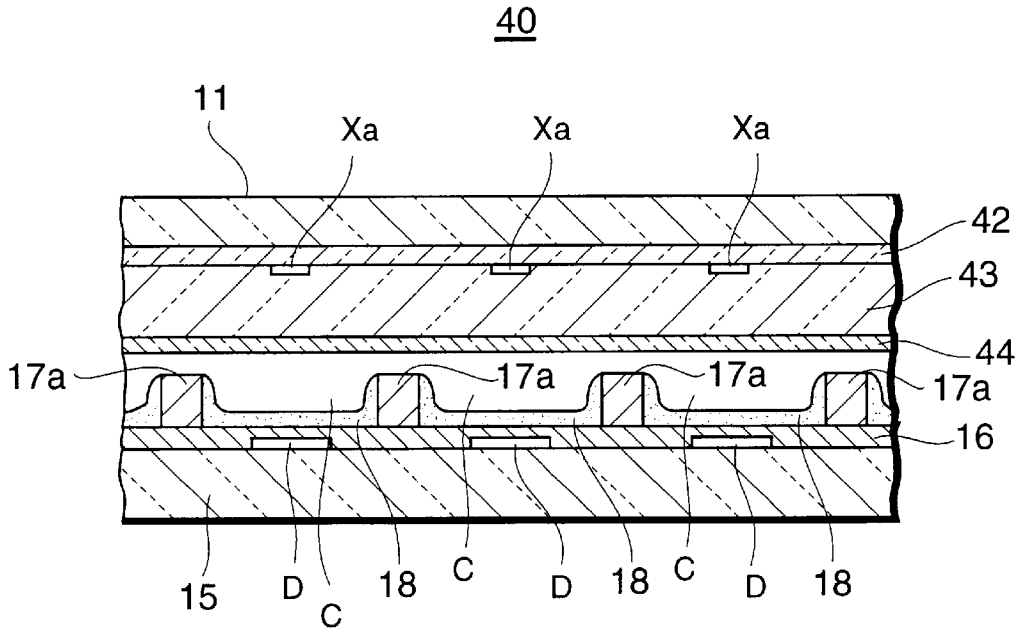
FIG. 12 is a transverse sectional view of the fourth example.
Figure 13:
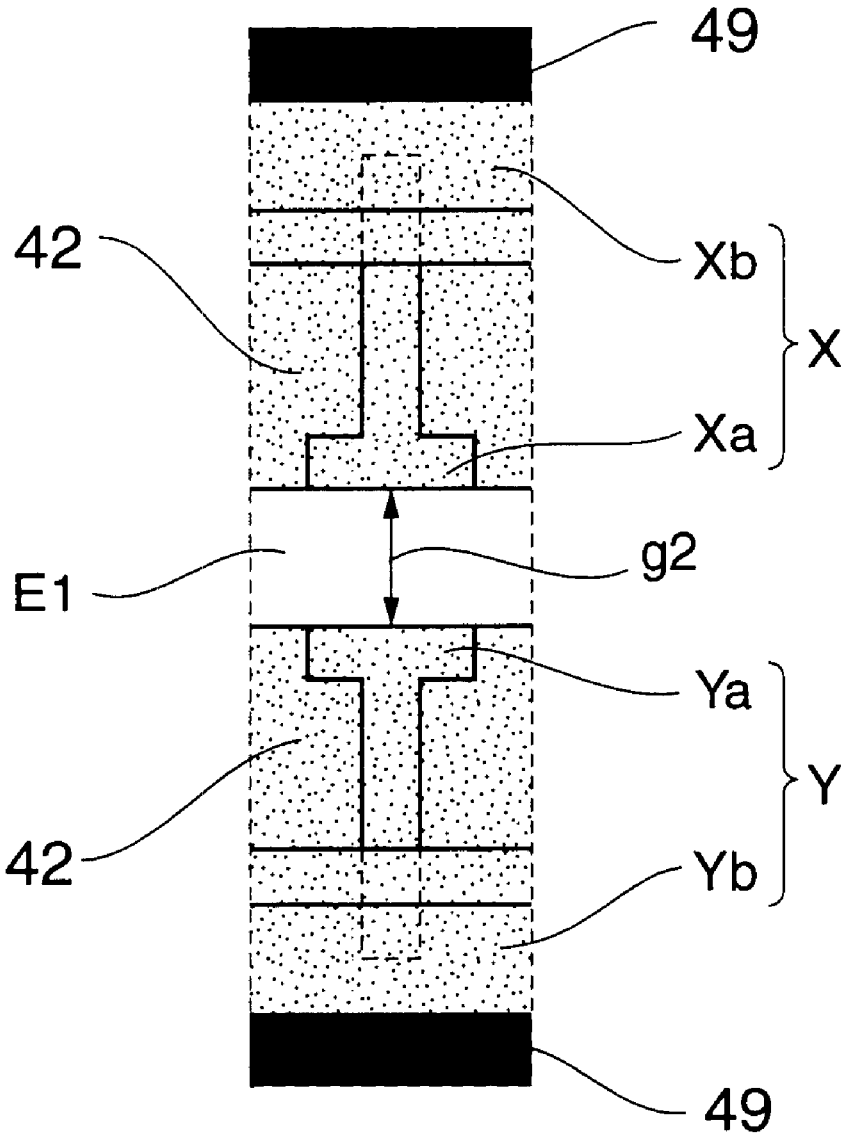
FIG. 13 is a schematic diagram showing a range in which a low dielectric constant layer is formed in a discharge cell in the fourth example.

FIGS. 11 to 13 illustrate a fourth example of the embodiment of the plasma display panel according to the present invention: FIG. 11 is a sectional view of the same position as that of FIG. 2 (the V1—V1 line) in the first example; FIG. 12 is a sectional view of the same position as that of FIG. 4 (the W1—W1 line); and FIG. 13 is a front view illustrating each of the discharge cells.

The PDP 40 in the fourth example includes a low dielectric constant layer 42 between the front glass substrate 11 and a dielectric layer 43 and at portions except at the inside of a discharge gap g2 between each of the row electrode pairs (X, Y), a band-shaped portion E1 facing the discharge gap g2 and extending in the row direction, and a portion facing the portion between the back-to-back bus electrodes Xb and Yb of the respective row electrode pairs (X, Y) adjacent to each other.

The light absorption layer, which has been provided between the back-to-back bus electrodes Xb and Yb in the PDP 10 of the first example, is provided at a portion facing the portion between the back-to-back bus electrodes Xb and Yb and interposed between the low dielectric constant layers 42.

At a portion on the back of the dielectric layer 43, overlaying the row electrode pair (X, Y), which is opposite to a discharge gap g2 and at a portion of a protective layer 44 corresponding to the above portion, recesses 43A and 44A are respectively bent toward the front glass substrate 11 in order not to differ in thickness of the above portion of each dielectric layer 43 and protective layer 44 from that of other portions thereof.

The configuration of other components of the PDP 40 is the same as that of the aforementioned PDP 10 of the first example, which are represented with the same reference numerals.

As in the PDP 20 of the second example, in the PDP 40, when the sustain discharge (surface discharge) is produced, as interelectrode capacitance formed by the row electrode pair (X, Y) and the front glass substrate 11 is reduced due to the provision of the low dielectric constant layer 42, reactive power reduces. In addition, the leading ends of the respective transparent electrodes Xa and Ya of the row electrodes X, Y in each pair are opposite each other through the dielectric layer 43 having a large relative dielectric constant. Thus, a distance for producing the discharge is shorter, resulting in decreasing a voltage for starting the discharge.

The PDP 40 allows the prevention of occurrence of cracking because the low dielectric constant layer 42 is divided so as to decrease an area of the continuous portion.

Figure 14:
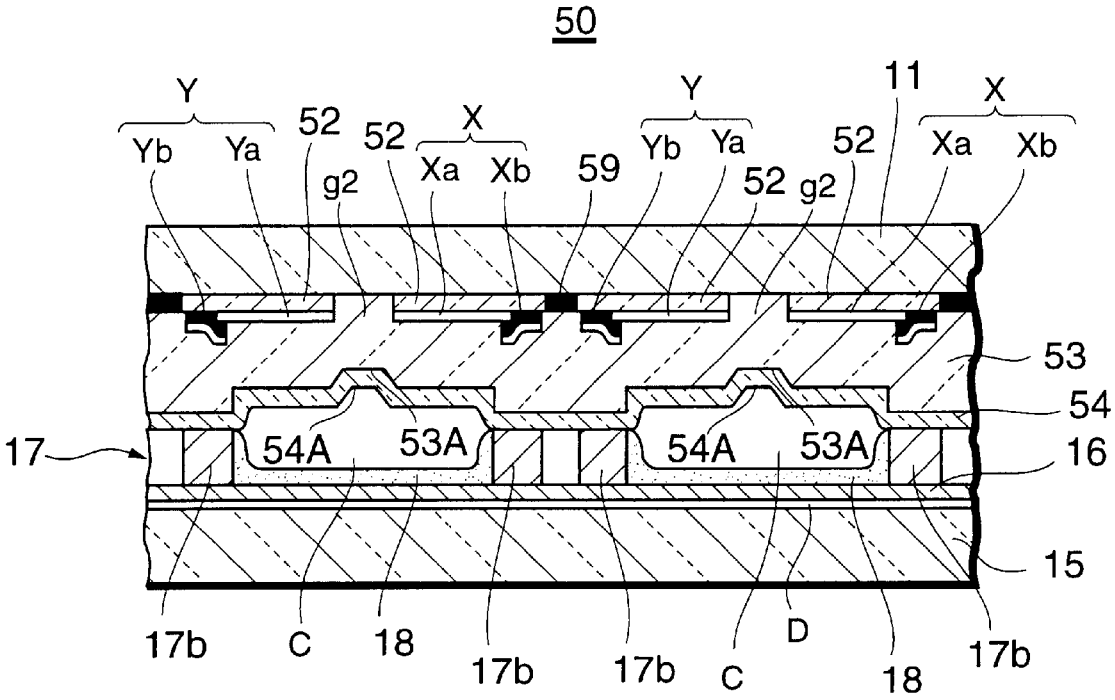
FIG. 14 is a side sectional view illustrating a fifth example according to the present invention.
Figure 15:
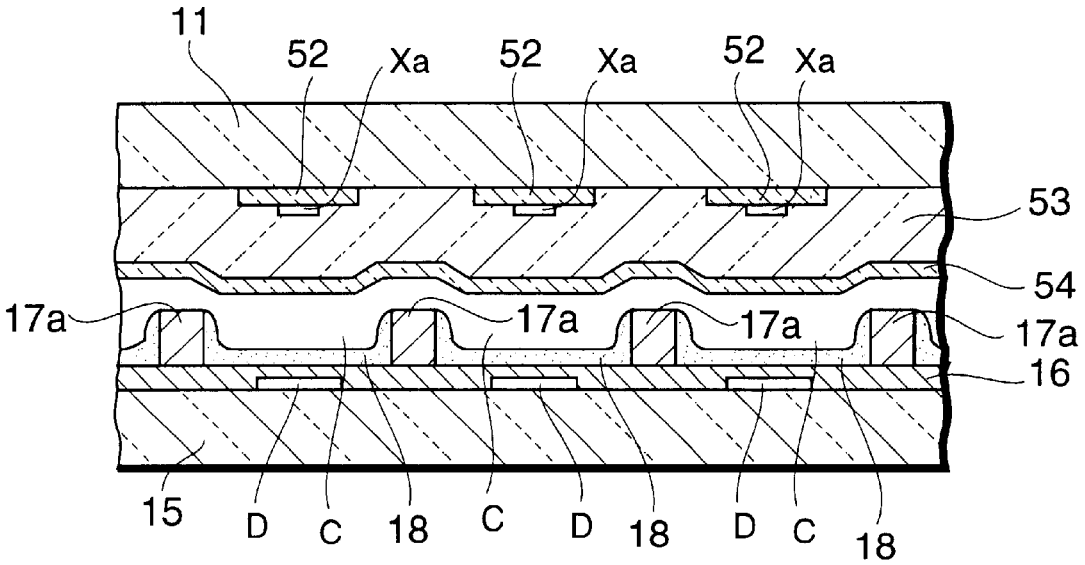
FIG. 15 is a transverse sectional view of the fifth example.
Figure 16:
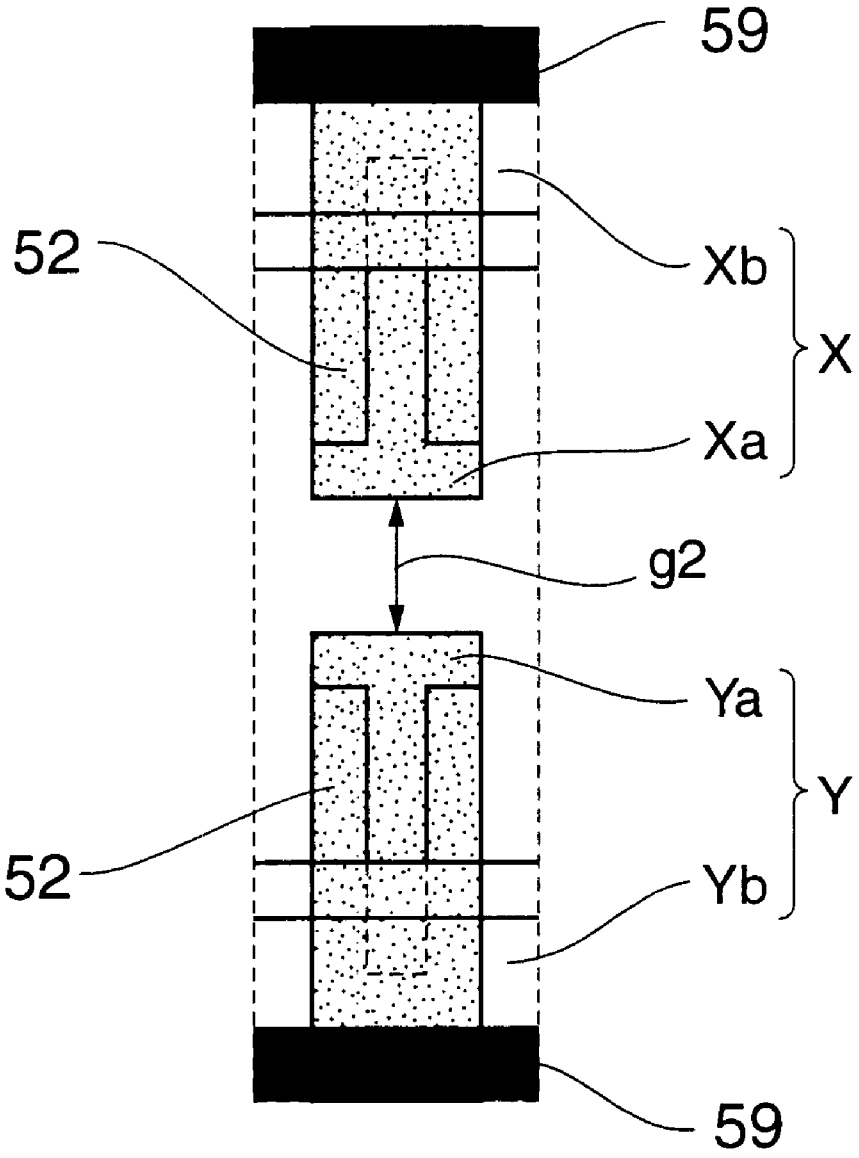
FIG. 16 is a schematic diagram showing a range in which a low dielectric constant layer is formed in a discharge cell in the fifth example.
Figure 17:
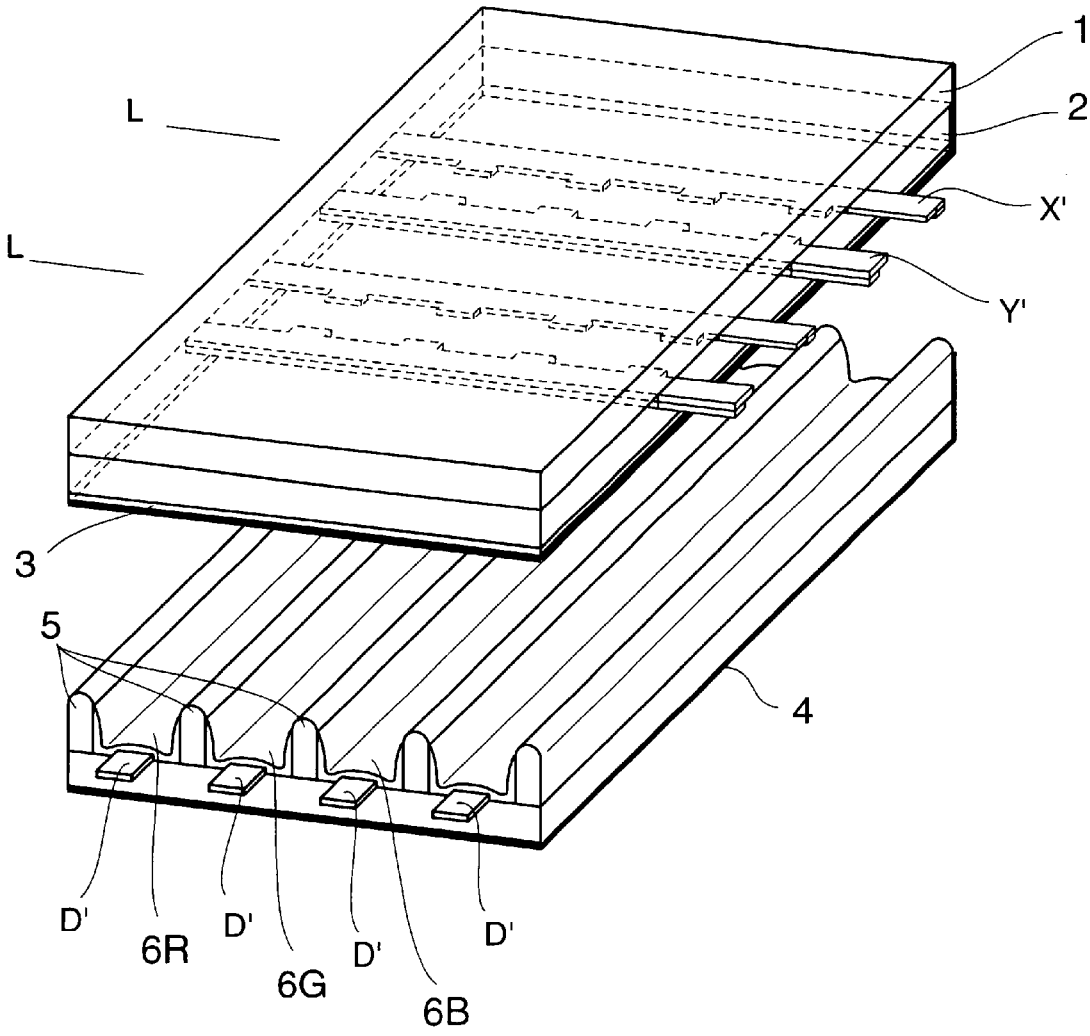
FIG.17 PRIOR ART
FIG. 17 is a perspective view illustrating an example of prior art.

FIGS. 14 to 16 illustrate a fifth example of the embodiment of the plasma display panel according to the present invention: FIG. 14 is a sectional view of the same position as that of FIG. 2 (the V1—V1 line) in the first example; FIG. 15 is a sectional view of the same position as that of FIG. 4 (the W1—W1 line); and FIG. 16 is a front view illustrating each of the discharge cells.

A PDP 50 in the fifth example includes a low dielectric constant layer 52, which is only located at a quadrate island-shaped portion including a portion facing each row electrode X, Y, between the front glass substrate 11 and a dielectric layer 53.

Accordingly, a low dielectric constant layer is not provided in the discharge gap g2 between each row electrode pair (X, Y) and the portion facing the discharge gap g2.

A light absorption layer 59 is formed in a band shape extending in the row direction at a portion facing the portion between the back-to-back bus electrodes Xb and Yb and interposed between the low dielectric constant layers 52.

At a portion on the back of the dielectric layer 53, overlaying the row electrode pair (X, Y), which is opposite to the discharge gap g2 and at a portion of a protective layer 54 corresponding to the above portion, recesses 53A and 54A are respectively bent toward the front glass substrate 11 in order not to differ in thickness of the above portion of each dielectric layer 53 and protective layer 54 from that of other portions thereof.

The configuration of other components of the PDP 50 is the same as that of the aforementioned PDP 10 of the first example, which are represented with the same reference numerals.

As in the PDP 20 of the second example, in the PDP 50, when the sustain discharge (surface discharge) is produced, as interelectrode capacitance formed by the row electrode pair (X, Y) and the front glass substrate 11 is reduced due to the provision of the low dielectric constant layer 52, reactive power reduces. In addition, the leading ends of the respective transparent electrodes Xa and Ya of the row electrodes X, Y in each pair are opposite each other through the dielectric layer 53 having a large relative dielectric constant. Thus, a distance for producing the discharge is shorter, resulting in decreasing a voltage for starting the discharge.

The PDP 50 allows the further prevention of cracking because the low dielectric constant layer 52 is divided to further decrease the area of the continuous portion in comparison with that in the PDP 40 of the fourth example.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a pair of substrates which face each other with a discharge space in between and one of which has an inner face on which row electrode pairs each opposing each other with a discharge gap in between, and a dielectric layer overlaying the row electrode pairs relative to the discharge space are provided, said plasma display panel comprising:

a low dielectric constant layer provided between said one substrate and the row electrode pair and having a relative dielectric constant lower than that of said one substrate.

2. The plasma display panel according to claim 1, wherein a relative dielectric constant of said low dielectric constant layer is six or less.

3. The plasma display panel according to claim 1, wherein said low dielectric constant layer includes $SiO_2$.

4. The plasma display panel according to claim 1, wherein said one substrate is a front substrate placed on the display surface side of the panel and wherein the low dielectric constant layer is formed of light-transmittable materials.

5. The plasma display panel according to claim 1, wherein said low dielectric constant layer is provided over almost the entire inner face of said one substrate.

6. The plasma display panel according to claim 1, wherein said low dielectric constant layer is provided on the inner face of said one substrate except on at least a portion opposite to a discharge gap between each of the row electrode pairs.

7. The plasma display panel according to claim 1, wherein said low dielectric constant layer is provided only on a portion, opposite to each of the row electrode pairs, of portions of the inner face of said one substrate which is opposite the discharge space.

8. The plasma display panel according to claim 1, wherein said low dielectric constant layer is formed in an island shape in each row electrode pair so as to separate it from other low dielectric constant layers.

9. The plasma display panel according to claim 1, wherein said low dielectric layer is provided on portions of the inner face of said one substrate except on a portion facing a portion between adjacent row electrode pairs, said plasma display panel further comprising a light absorption layer provided on the portion, facing the portion between the adjacent row electrode pairs, of the inner face of said one substrate.

* * * * *